US006705429B2

(12) United States Patent
Kaku et al.

(10) Patent No.: US 6,705,429 B2
(45) Date of Patent: Mar. 16, 2004

(54) MUFFLER

(75) Inventors: Yoichi Kaku, Yokohama (JP); Kai Takeuchi, Tokyo (JP); Hidefumi Mihara, Kanagawa (JP); Tsuyoshi Murakami, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/351,434

(22) Filed: Jan. 27, 2003

(65) Prior Publication Data

US 2003/0155175 A1 Aug. 21, 2003

(30) Foreign Application Priority Data

Feb. 18, 2002 (JP) ..... 2002-040636

(51) Int. Cl.[7] ..... F01N 7/08
(52) U.S. Cl. ..... 181/227
(58) Field of Search ..... 181/227, 228, 181/268, 269, 272, 275, 282, 212

(56) References Cited

U.S. PATENT DOCUMENTS

| | | | | |
|---|---|---|---|---|
| 4,192,402 A | * | 3/1980 | Nakagawa et al. | 181/256 |
| 4,333,544 A | * | 6/1982 | Seeger | 181/266 |
| 4,700,805 A | * | 10/1987 | Tanaka et al. | 181/265 |
| 5,025,890 A | * | 6/1991 | Hisashige et al. | 181/272 |
| 5,614,699 A | | 3/1997 | Yashiro et al. | |
| 5,723,827 A | | 3/1998 | Sasaki et al. | |
| 5,823,600 A | | 10/1998 | Iwao | |

FOREIGN PATENT DOCUMENTS

| | | | |
|---|---|---|---|
| EP | 0 863 054 | A2 | 9/1998 |
| EP | 0 869 037 | A2 | 10/1998 |
| EP | 0 889 459 | A2 | 1/1999 |
| JP | 7-13573 | A | 1/1995 |
| JP | 7-175485 | A | 7/1995 |
| JP | 8-314469 | A | 11/1996 |
| JP | 9-125930 | A | 5/1997 |
| JP | 11-132024 | A | 5/1999 |

* cited by examiner

*Primary Examiner*—Kimberly Lockett
(74) *Attorney, Agent, or Firm*—Foley & Lardner

(57) ABSTRACT

A muffler comprises a case having opposed ends closed; a partition structure installed in the case to constitute a sound silencing path; inlet and outlet pipes incorporated with the sound silencing path; and a sound shielding wall structure installed in the case to constitute a part of the sound silencing path. The sound shielding wall structure comprises first and second partition plates; a positioning structure that puts the first and second partition plates together to keep a given distance therebetween; a first group of projections defined by the first partition plate and projected toward the second partition plate, each projection of the first group having a first opening formed therethrough; and a second group of projections defined by the second partition plate and projected toward the first partition plate, each projection of the second group having a second opening formed therethrough, the projections of the second group respectively facing the projections of the first group having a given clearance kept therebetween.

17 Claims, 8 Drawing Sheets

MUFFLER

BACKGROUND OF INVENTION

1. Field of Invention

The present invention relates in general to mufflers and more particularly to mufflers of a type that is suitable for use with an internal combustion engine to muffle or silence exhaust noise produced by the engine.

2. Description of Related Art

Hitherto, various types of mufflers have been proposed and put into practical use particularly in the field of automotive internal combustion engines.

One of such mufflers is shown in Laid-open Japanese Patent Application (Tokkaihei) 9-125930. In FIGS. 15 and 16 of the accompanying drawings, there is shown the muffler of the Laid-open Application. FIG. 15 is a sectional view of the muffler and FIG. 16 is a sectional view taken along the line "XVI—XVI" of FIG. 15. As is seen from the drawings, the muffler comprises a semi-cylindrical outer case 301 having longitudinal ends 301*a* and 301*b* closed, and a regularly cylindrical inner case 302 installed in outer case 301 to extend longitudinally. As is seen from FIG. 15, inner case 302 has a gas inlet part "IN" and a gas outlet part "OUT" at longitudinal ends. Within inner case 302, there are arranged front and rear inner sections 303 and 304 each having a cylindrical wall 302*a* with a plurality of small openings 303*a* and 304*a*. Between front and rear inner sections 303 and 304, there is arranged an intermediate space section 306 that comprises a partition wall 305 formed with a plurality of small openings 306*a*. Within an annular space defined between outer and inner cases 301 and 302, there are arranged front and rear outer sections 403 and 404 that are separated by an intermediate space section 308 that comprises a partition wall 307 formed with a plurality of small openings 308*a*. In operation, exhaust gas from an associated engine enters front inner section 303 through gas inlet part "IN". One part of gas in front inner section 303 is led to rear inner section 304 through intermediate space section 306 and discharged to open air through gas outlet part "OUT", while the remaining part of gas in front inner section 303 is led into front outer section 403 through small openings 303*a*, into rear outer section 404 through small openings 308*a*, into rear inner section 304 through small openings 304*a* and discharged to open air through gas outlet part "OUT". During such flow in the muffler, acoustic energy or noise of the exhaust gas is reduced or damped due to expansion/resonance effect possessed by the gas flow passages.

While, Laid-open Japanese Patent Applications (Tokkaihei) 7-13573 and 7-175485 show a sound insulating structure that is used as an under cover of an engine room of a motor vehicle for blocking noises of exhaust system of the engine from being emitted to open air. That is, for blocking noises of exhaust system, the sound insulting structure employs an acoustically improved mechanism.

Laid-open Japanese Patent Application (Tokkaihei) 11-132024 shows a muffler that is produced by practically employing the acoustically improved mechanism of the above-mentioned publications 7-13573 and 7-175485.

SUMMARY OF INVENTION

However, due to inherent construction, the above-mentioned known mufflers have failed to provide users with a satisfaction. That is, some are poor in muffling performance, some are high in cost or some are difficult to assemble.

It is therefore an object of the present invention to provide a muffler that is high in muffling performance, low in cost and easy to assemble.

According to a first aspect of the present invention, there is provided a muffler which comprises a case having opposed ends closed; a partition structure installed in the case to constitute a sound silencing path; inlet and outlet pipes incorporated with the sound silencing path; and a sound shielding wall structure installed in the case to constitute a part of the sound silencing path, wherein the sound shielding wall structure comprises first and second partition plates; a positioning structure that puts the first and second partition plates together to keep a given distance therebetween; a first group of projections defined by the first partition plate and projected toward the second partition plate, each projection of the first group having a first opening formed therethrough; and a second group of projections defined by the second partition plate and projected toward the first partition plate, each projection of the second group having a second opening formed therethrough, the projections of the second group respectively facing the projections of the first group having a given clearance kept therebetween.

According to a second aspect of the present invention, there is provided a muffler which comprises a case having opposed ends closed; at least one partition plate installed in the case to divide an interior of the same into two chambers; a sound shielding wall structure installed in one of the two chambers to divide the same into first and second sound chambers allowing the other one of the two chambers to serve as a third sound chamber; and pipe members projected into the case passing through the partition plate and the sound shielding wall structure to define in the case a sound silencing path including the first, second and third sound chambers, wherein the sound shielding wall structure comprises first and second partition plates; a positioning structure that puts the first and second partition plates together to keep a given distance therebetween; a first group of projections defined by the first partition plate and projected toward the second partition plate, each projection of the first group having a first opening formed therethrough; and a second group of projections defined by the second partition plate and projected toward the first partition plate, each projection of the second group having a second opening formed therethrough, the projections of the second group respectively facing the projections of the first group having a given clearance kept therebetween.

DETAILED DESCRIPTION OF EMBODIMENTS

In the following, the present invention will be described in detail with reference to the accompanying drawings.

Referring to FIGS. 1 to 6, there is shown a muffler 50 according to the present invention.

Figure 1:
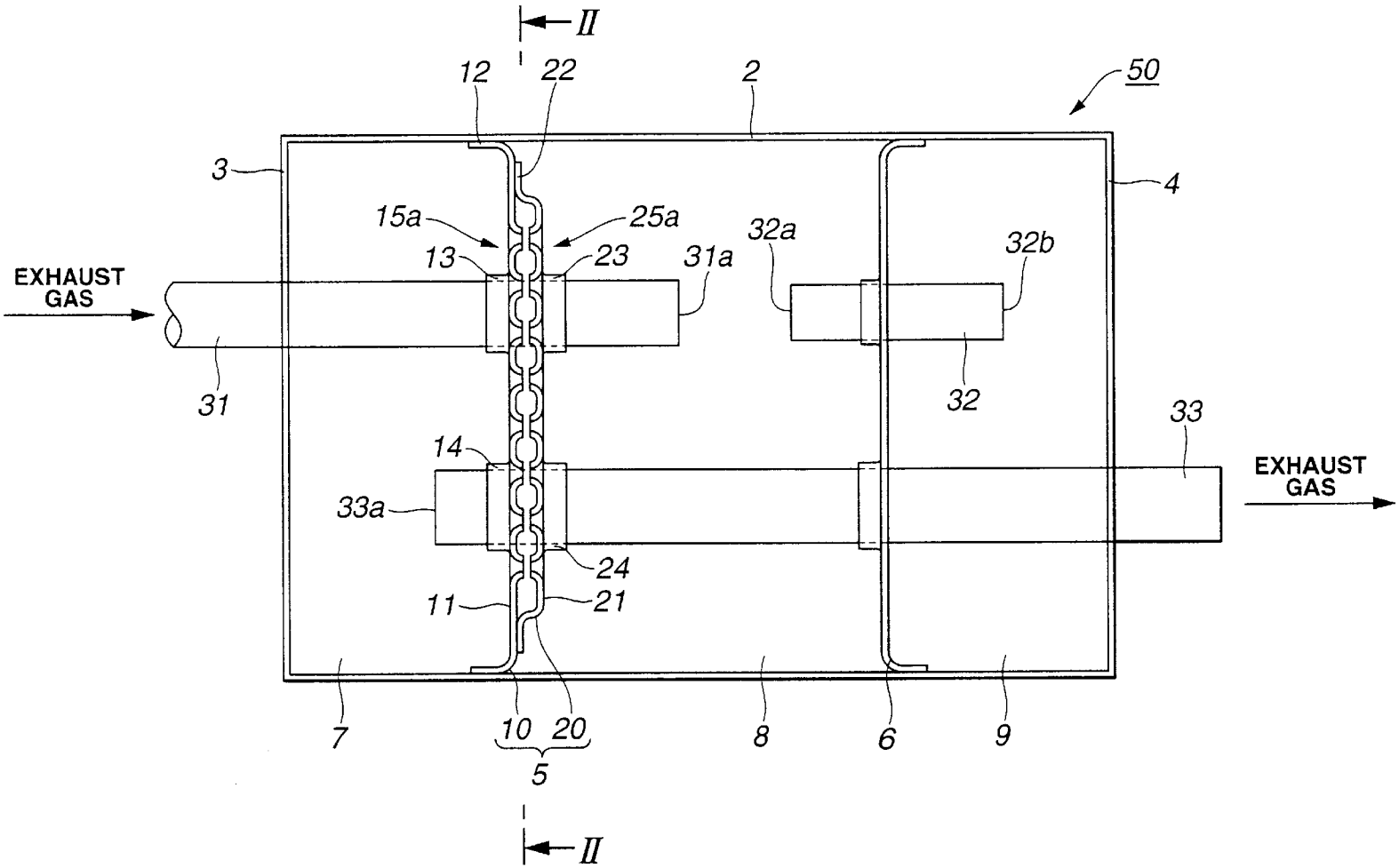
FIG. 1 is a sectional view of a muffler that is an embodiment of the present invention.
Figure 2:
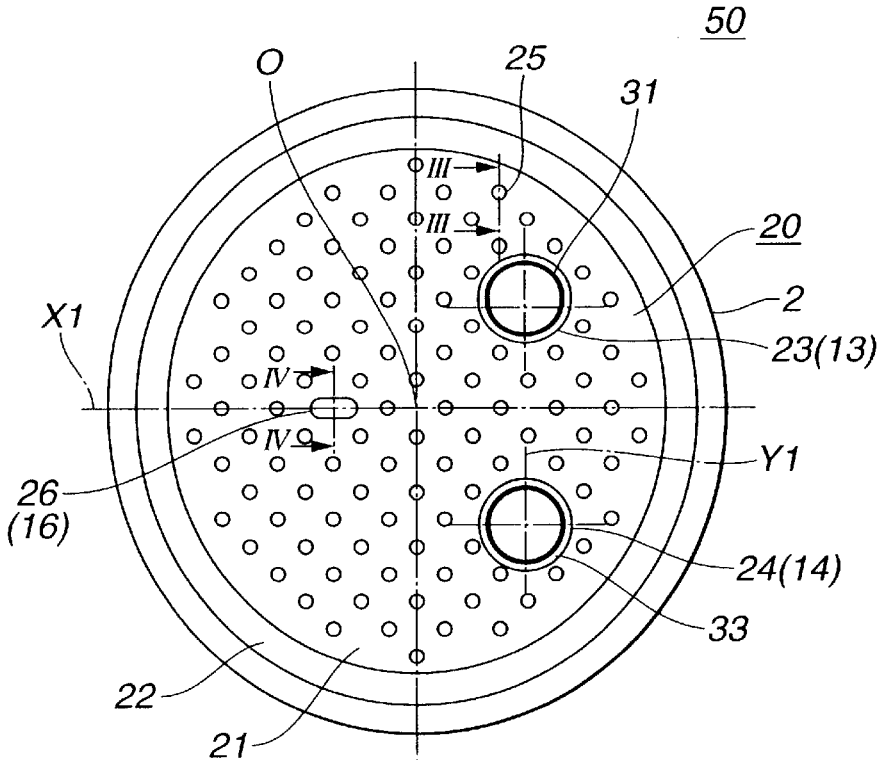
FIG. 2 is a sectional view taken along the line "II—II" of FIG. 1.

As is best seen from FIGS. 1 and 2, muffler 50 comprises a cylindrical outer case 2 that has longitudinal ends 3 and 4 closed. In practice, front and rear plates are welded to longitudinal open ends of outer case 2 to constitute the closed ends 3 and 4.

Hereinafter, the closed ends 3 and 4 will be referred to front and rear plates for ease of description. Furthermore, for easy understanding, the portion of outer case 2 where front plate 3 is provided will be referred to a front portion of muffler 50, and the portion of outer case 2 where rear plate 4 is provided will be referred to a rear portion of muffler 50.

As is seen from FIG. 1, within outer case 2, there are arranged a sound shielding wall structure 5 and a partition plate 6 which are axially spaced. With provision of such wall structure 5 and partition plate 6, there are defined first, second and third sound chambers 7, 8 and 9 in outer case 2. That is, first and third sound chambers 7 and 9 are respectively provided at the front and rear portions of muffler 50, and second sound chamber 8 is placed between first and third sound chambers 7 and 9.

Sound shielding wall structure 5 generally comprises first and second circular partition plates 10 and 20 which are put on each other in an after-mentioned manner.

An inlet pipe 31 is inserted into outer case 2 from the front portion in a manner to pass through front plate 3 and sound shielding wall structure 5. As shown, inlet pipe 31 extends along a given axis eccentric to a center axis of outer case 2 and has an open inner end 31*a* exposed to second sound chamber 8.

Although not shown in the drawings, inlet pipe 31 is connected to an exhaust part of an associated engine through an exhaust pipe.

A shorter resonator pipe 32 is held by partition plate 6 to extend along the given axis of inlet pipe 31. Resonator pipe 32 has front and rear open ends exposed to second and third sound chambers 8 and 9, so that second and third sound chambers 8 and 9 are communicated through resonator pipe 32.

An outlet pipe 33 is inserted into outer case 2 from the rear portion in a manner to pass through rear plate 4, partition plate 6 and sound shielding wall structure 5.

As is best seen from FIG. 2, outlet pipe 33 extends along another given axis eccentric to the center axis "0" of outer case 2. More specifically, inlet pipe 31 and outlet pipe 33 are arranged symmetrically with respect to an imaginary plane "X1" that includes the center axis "0" and extends along the same.

As is seen from FIG. 1, outlet pipe 33 has an open inner end 33*a* exposed to first sound chamber 7 and has an open outer end exposed to open air.

In the following, the detail of sound shielding wall structure 5 will be described with the aid of the drawings.

As has been described hereinabove, the wall structure 5 comprises generally first and second circular partition plates 10 and 20 that are put on each other.

As is seen from FIG. 1, first partition plate 10 has an outer diameter identical to an inner diameter of outer case 2. As is seen from FIGS. 1 and 5, first partition plate 10 comprises a main portion 11 that has a cylindrical peripheral edge 12 that is directed forward to be neatly received in outer case 2.

Figure 5:
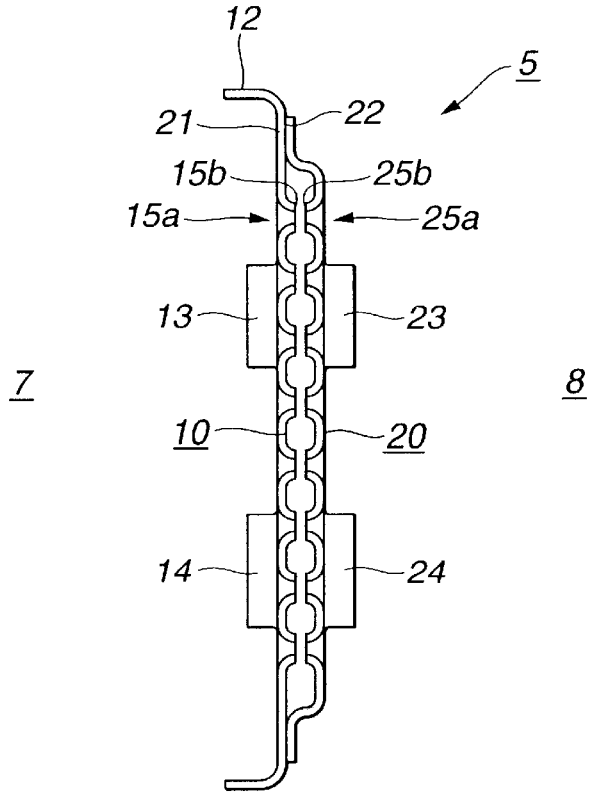
FIG. 5 is a sectional view of the sound shielding wall structure.

As is seen from FIG. 5, main portion 11 is formed with supporting portions 13 and 14 for supporting inlet and outlet pipes 31 and 33 respectively. Furthermore, main portion 11 is formed with a plurality of openings 15*a* and a positioning projection (no numeral). As will be described hereinafter, the positioning projection is used for achieving a relative positioning between first and second partition plates 10 and 20. As is seen from FIG. 3, each opening 15*a* of main portion 11 is defined in a rearward projected portion formed on main portion 11.

Figure 6:
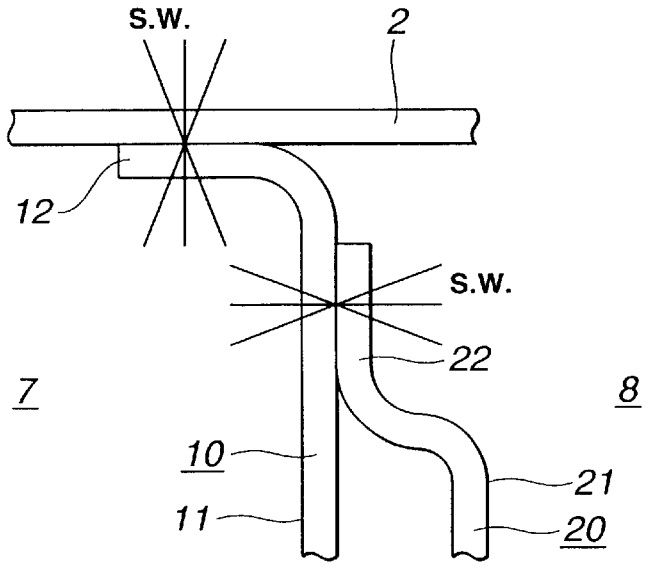
FIG. 6 is an enlarged sectional view of a part of the sound shielding wall structure where spot-welding is used.

As is seen from FIGS. 1 and 6, cylindrical peripheral edge 12 of first partition plate 10 is spot-welded to the inner wall of outer case 2.

As is seen from FIGS. 1 and 5, second partition plate 20 of sound shielding wall structure 5 has a diameter that is smaller is than that of first partition plate 10. A main portion 21 of second partition plate 20 is formed with supporting portions 23 and 24 for supporting inlet and outlet pipes 31 and 33 respectively. Furthermore, main portion 21 is formed with a plurality of openings 25*a* and a positioning projection 26. As will be described hereinafter, the positioning projection 26 is used for achieving the relative positioning between first and second partition plates 10 and 20. As is seen from FIG. 3, each opening 25*a* of main portion 21 is defined in a forward projected portion formed on main portion 21.

As is seen from FIGS. 5 and 6, a circular peripheral edge 22 of main portion 21 is spot-welded to a peripheral portion of a rear surface of main portion 11 of first partition plate 10.

Accordingly, as is seen from FIG. 6, respectively main portions 21 and 11 of second and first partition plates 20 and 10 are spaced apart by a certain distance. More specifically, as is seen from FIG. 3, a leading edge of each rearward projected portion (15) of first partition plate 10 and that of each forward projected portion (25) of second partition plate 20 are spaced apart by a predetermined distance of "L".

In the following, the detail of openings 15*a* and 25*a* of first and second partition plates 10 and 20 will be described with reference to FIG. 3 that is an enlarged, partial and sectional view taken along the line "III—III" of FIG. 2.

Figure 3:
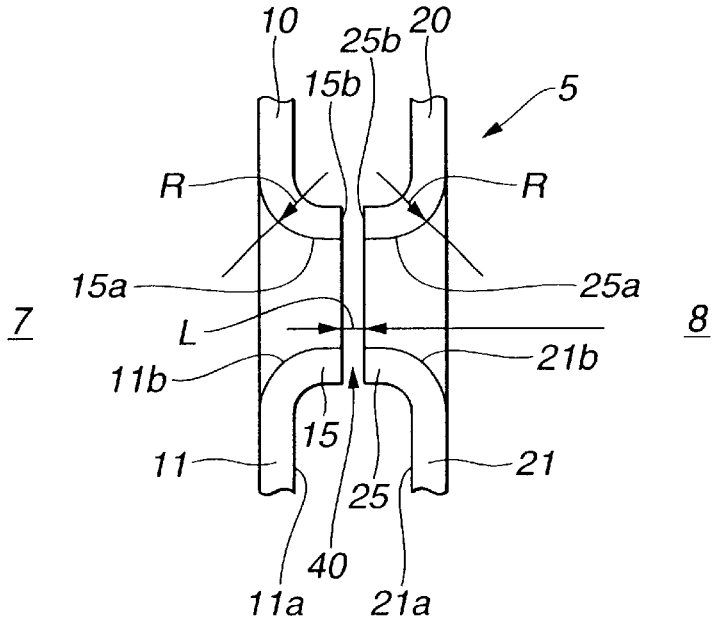
FIG. 3 is an enlarged sectional view of a portion of a sound shielding wall structure employed by the muffler of the invention.

As is seen from FIG. 3, first and second partition plates 10 and 20 are formed with first and second groups of projections 15 and 25 each having an opening 15*a* or 25*a*. That is, each of first group of projections 15 of first partition plate 10 and that of second group of projections 25 of second partition plate 20 are arranged to face each other keeping the given distance "L" therebetween. As is understood from FIG. 2, projections 15 and 25 (or openings 15*a* and 25*a*) formed in first and second partition plates 10 and 20 are arranged to have a given distribution suitable for obtaining a desired performance.

As is described hereinabove, each rearward projection 15 of first partition plate 10 and corresponding forward projection 25 of second partition plate 20 faces each other with a space of "L" kept therebetween. The space is denoted by numeral 40 in FIG. 3. It is to be noted that the opening 15*a* of each rearward projection 15 of first partition plate 10 is coaxial with the opening 25*a* of the corresponding forward projection 25 of second partition plate 20. That is, the openings 15*a* and 25*a* of first and second partition plates 10 and 20 are communicated through the space 40.

As is understood from FIG. 3, each opening 15*a* or 25*a* of first or second partition plate 10 or 20 is of a cylindrical shape having a smoothly curved inner wall 11*b* or 21*b*. A radius of curvature possessed by each opening 15*a* or 25*a* is denoted by "R" in the drawing. Due to provision of such smoothly curved inner walls 11*b* and 21*b*, exhaust gas flow from second sound chamber 8 to first sound chamber 7 is smoothly made, which suppresses or at least minimizes any noise produced when the gas flows in openings 25*a* and 15*a*. Furthermore, by the same reason, undesired separation of gas flow and construction flow, such as those described in Laid-open Japanese Patent Application (Tokkaihei) 11-132024, are suppressed or at least minimized.

In the following, positioning openings 16*a* and 26*a* respectively formed in first and second partition plates 10 and 20 for achieving a relative positioning between the two plates 10 and 20 will be described with reference to FIG. 4 that is an enlarged, partial and sectional view taken along the line "IV—IV" of FIG. 2.

Figure 4:
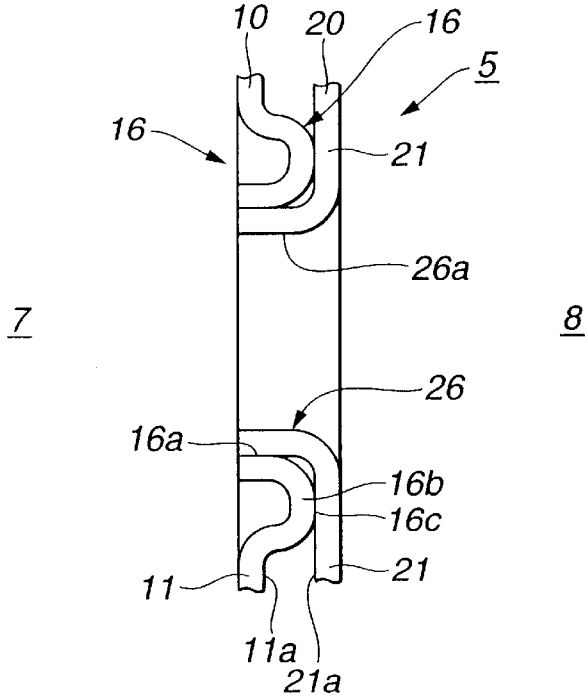
FIG. 4 is an enlarged sectional view of a positioning structure employed by the sound shielding wall structure.

As is seen from FIG. 4, first partition plate 10 is formed with a positioning projection 16 that projects rearward. Positioning projection 16 has an opening 16*a* formed therethrough. Second partition plate 20 is formed with a positioning projection 26 that projects forward. Projection 26 has an opening 26 formed therethrough. As shown, Projection 26 of second partition plate 20 is press-fitted into opening 16*a* of positioning projection 16 of first partition plate 10. That is, positioning projection 16 of first partition plate 10 projects rearward from a rear surface 11*a* of mail portion 11 of the same, and projection 26 of second partition plate 20 projects forward from a front surface 21*a* of main portion 21 thereof. More specifically, as is seen from the drawing, positioning projection 16 is constructed to have a rounded bank portion 16*b* that projects rearward. It is to be noted that opening 16*a* of positioning projection 16 has an oval shape.

Furthermore, as is seen from FIG. 4, projection 26 of second partition plate 20 has an oval cross section and has an oval opening 26*a* formed therethrough. That is, due to matching in shape, projection 26 of second partition plate 20 is intimately fitted in opening 16*a* of first partition plate 10 thereby to achieve a relative positioning between first and second partition plates 10 and 20. Upon coupling, the front surface 21*a* of second partition plate 20 abuts against a top 16*c* of rounded bank portion 16*b* of first partition plate 10, as shown. Due to provision of the mutually engaged projections 16 and 26, openings 15*a* and 25*a* of first and second partition plates 10 and 20 precisely face to one another. Because of the oval shape of projection 26 and opening 16*a*, a play between first and second partition plates 10 and 20 is suppressed once they are tightly mated. Furthermore, manual work for coupling the positioning projection 26 with the positioning opening 16*a* is easily made because the shape of opening 16*a* is different from that of openings 15*a*.

With the above-mentioned openings 15*a*, 25*a* and 26*a* possessed by sound shielding wall structure 5, there is provided a fluid communication between first and second sound chambers 7 and 8.

It is now to be noted that the positioning projections 16 and 26 are provided at given portions of first and second partition plates 10 and 20 where the plates 10 and 20 are subjected to a primary vibration of resonance. With this measure, undesired noise caused by the resonance is suppressed or at least minimized.

More specifically, as is seen from FIG. 2, in muffler 50 of the invention, positioning projections 16 and 26 are placed on an imaginary line "X1" at a position (26, 16) that is opposite to a position where the line "X1" and another imaginary line "Y1" passing through central portions of supporting portions 23 and 24 that support inlet and outlet pipes 31 and 33 intersect at right angles, the line "X1" being a line that passes through the center axis "0" of outer case 2 and is perpendicular to the imaginary line "Y1".

In the following, assembling steps for installing sound shielding wall structure 5 in outer case 2 will be described.

First, as is understood from FIG. 5 and FIG. 4, first and second partition plates 10 and 20 are coupled together having positioning projection 26 of second plate 20 press-fitted into the positioning opening 16*a* of first plate 10. Then, as is seen from FIG. 6, the circular peripheral edge 22 of second plate 20 is spot-welded to the peripheral portion of the rear surface of first plate 10. With these steps, sound shielding wall structure 5 is produced. In the produced structure 5, as is understood from FIG. 3, each opening 15*a* of first plate 10 faces the corresponding opening 25*a* of second plate 20 keeping a certain distance "L" therebetween.

Then, as is seen from FIG. 6, the sound shielding wall structure 5 thus produced is put into outer case 2 and the cylindrical peripheral edge 12 of first plate 10 is spot-welded to the inner wall of outer case 2.

In the following, operation of muffler 50 will be described with reference to FIG. 1.

As has been described hereinabove, inlet pipe 31 is connected to an exhaust part of an associated internal combustion engine through an exhaust pipe, and outlet pipe 33 has the open end exposed to the open air.

Under operation of the engine, exhaust gas is led into muffler 2 through inlet pipe 31. Thus, in inlet pipe 31, there is produced a pulsation flow of exhaust gas. The exhaust gas is led into second sound chamber 8 at first. Then, a part of the gas is led into third sound chamber 9 through resonator pipe 32.

While, a greater part of the gas in second sound chamber 8 is led into first sound chamber 7 through the openings 15*a*, 25*a* and 26*a* of sound insulating wall structure 5, and led into the open air through outlet pipe 33.

It is to be noted that under flowing of the exhaust gas from second sound chamber 8 to first sound chamber 7 through the openings 15*a*, 25*a* and 26*a*, a suitable sound shielding effect is carried out by sound insulating wall structure 5 and thus muffler 50 can effectively shield the noise of the exhaust gas. Acoustic mechanism for damping the noise will be described hereinafter.

If desired, the following modification 5A of sound shielding wall structure 5 may be employed in muffler 50 of the invention.

Figure 7:
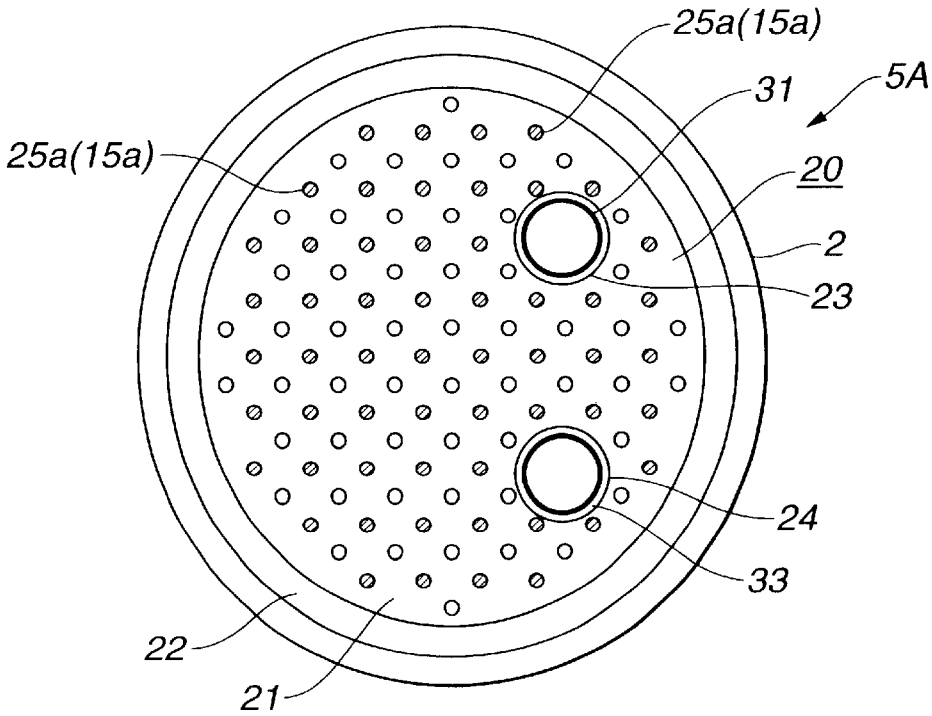
FIG. 7 is a view similar to FIG. 2, but showing a modification of the sound shielding wall structure.

That is, as is seen from FIG. 7, about a half of openings 15*a* and 25*a* of first and second partition plates 10 and 20 may be directly connected without producing a clearance "L" therebetween. In this drawing, openings 25*a* (or 15*a*) illustrated by hatched circles are those that leave the clearance "L", while openings 25*a* (or 15*a*) illustrated by blank circles are those that have no clearance "L". As is seen from this drawing, these two types of openings 25*a* (or 15*a*) are uniformly distributed.

Furthermore, if desired, the openings 25*a* (or 15*a*) that have no clearance "L" may have the same construction as the above-mentioned positioning opening 26*a* (or 16*a*) of positioning projection 26 (or 16). That is, a so-called male-female connection is made between the openings 25*a* and 15*a*. Thus, in this case, because of provision of the male-female connection, there is no need of providing the above-mentioned positioning projections 16 and 26.

In the following, acoustic mechanism for damping or silencing the exhaust noise by muffler 50 of the invention will be described with the aid of disclosure of Laid-open Japanese Patent Application (Tokkaihei) 7-175485.

Figure 8:
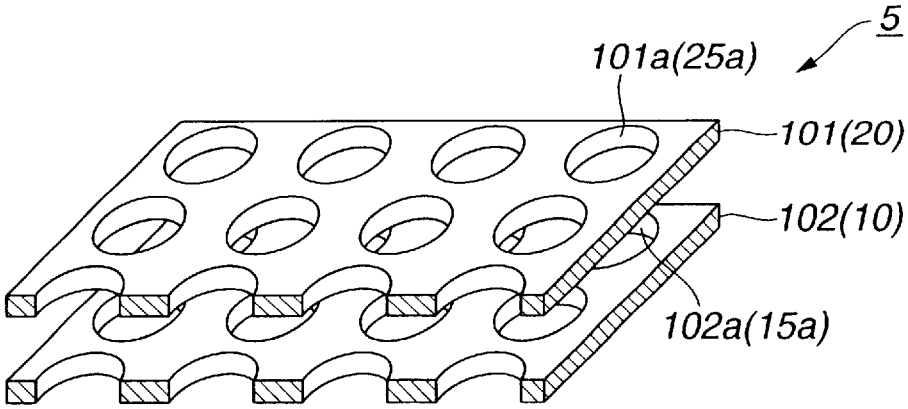
FIG. 8 is a view schematically showing two partition plates employed in the sound shielding wall structure.
Figure 9:
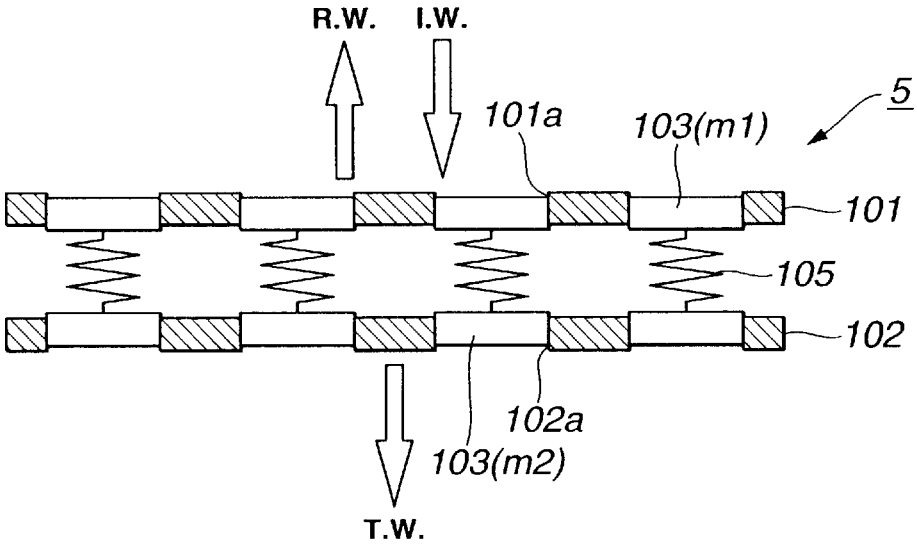
FIG. 9 is a view of a vibration model for explaining an acoustic mechanism established by the sound shielding wall structure.

Referring to FIGS. 8 and 9, there is diagrammatically shown sound shielding wall structure 5 provided by muffler 50 of the invention. FIG. 9 shows a vibration model for explaining the acoustic mechanism established by the sound shielding wall structure 5.

As is seen from FIG. 8, the sound shielding wall structure 5 comprises first and second partition plates 101 and 102 that correspond to the above-mentioned first and second partition plates 20 and 10 respectively. These two plates 101 and 102 are spaced from each other by the distance "L". Each plate 101 or 102 has a plurality of openings 101*a* or 102*a*, which correspond to 25*a* or 15*a* of the above-mentioned plates 20 and 10. As shown, the openings 101*a* are arranged to face the openings 102*a* respectively.

When, as is seen from FIG. 9, it is assumed that the mass of air in openings 101*a* and 102*a* is "m" and air put between first and second partition plates 101 and 102 serves as an air spring 105 of spring constant "k", a given vibration system with two factors (viz., "m" and "k") is established. In FIG. 9, denoted by reference I.W. is an incident wave, R.W. is a reflected wave and T.W. is a transmitted wave.

With the vibration system thus established, the following consideration would be provided.

That is, when air 103 of mass "m1" in openings 101*a* of first partition plate 101 is vibrated by the open air (viz., exhaust gas led into second sound chamber 8), the vibration is transmitted through the air spring 105 to air 103 of mass "m2" in openings 102*a* of second partition plate 102. The vibration of air 103 of mass "m2" then vibrates the open air (viz., exhaust gas in first sound chamber 7). The vibration of the open air produces the noise of exhaust gas.

In such acoustic mechanism, attention is paid on a transmission rate of vibration between air 103 of mass "m1" and air 103 of mass "m2". That is, in the vibration system with two factors (viz., "m" and "k"), a certain sound shielding effect is obtained when, with the vibration kept above a resonance point, the vibration transmission rate is smaller than 1 (one). That is, in the acoustic system of FIG. 9, first and second partition plates 101 and 102 can exhibit a sound shielding effect when they are vibrated at a frequency higher than a resonance frequency. The resonance frequency of the acoustic system of FIG. 9 can be controlled by varying the thickness of first and second partition plates 101 and 102, the number of openings 101*a* and 102*a* and the distance between the two plates 101 and 102. By practically employing this fact, the acoustic system can be adjusted to shield a noise having a specified frequency. That is, in the present invention, sound shielding wall structure 5 installed in outer case 2 practically uses the acoustic mechanism of FIG. 9.

In the following, description will be directed to the modification of sound shielding wall structure 5 wherein some or about a half of openings 15*a* and 25*a* of first and second partition is plates 10 and 20 are directly connected without leaving the clearance "L" therebetween.

Figure 10:
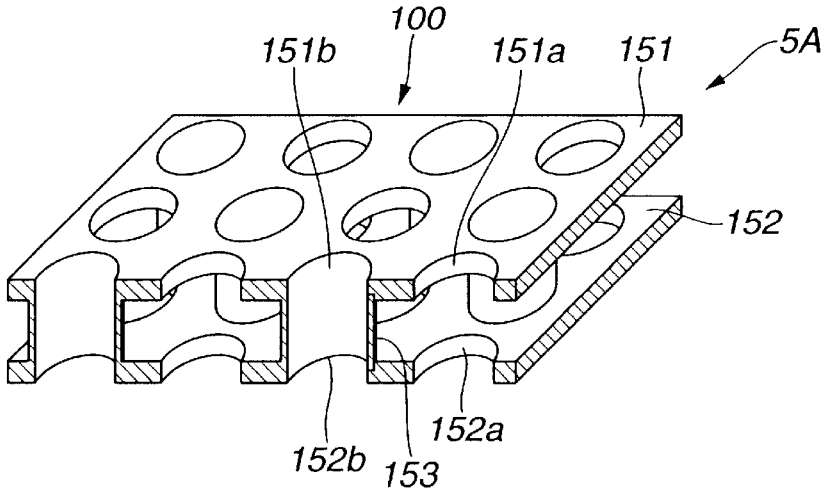
FIG. 10 is a view similar to FIG. 9, but showing a modification of the sound shielding wall structure.
Figure 11:
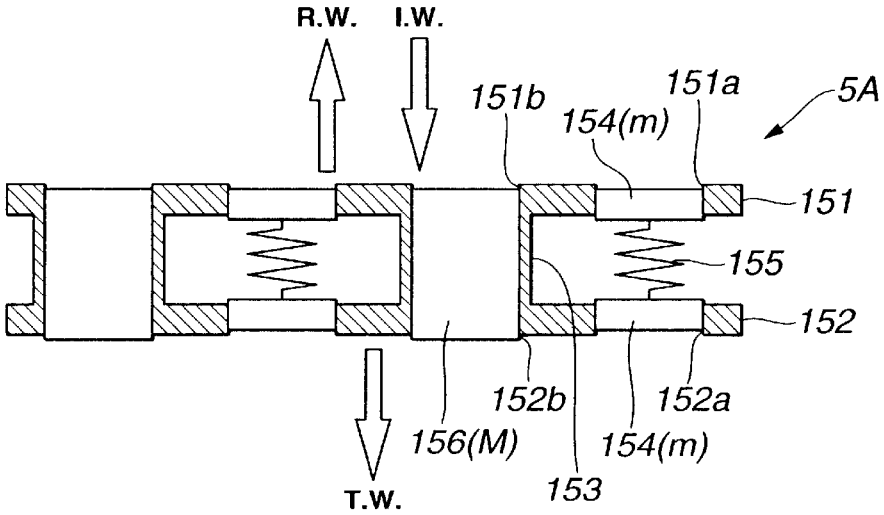
FIG. 11 is a view similar to FIG. 9, but showing an acoustic mechanism established by the modification of FIG. 10.

Referring to FIGS. 10 and 11, there is schematically shown the modification of the shielding wall structure 5. FIG. 11 shows a vibration model for explaining the acoustic mechanism established in the modification.

As is seen from FIG. 10, in this modification, like in the above-mentioned wall structure 5, two partition plates 151 and 152 having respective openings 151*a*, 151*b*, 152*a* and 152*b* are provided. However, as is seen, some 151*b* of the openings of first plate 151 are connected to corresponding openings 152*b* of second plate 152 through tubular portions 153.

As is seen from FIG. 11, due to provision of such tubular portions 153, first and second partition plates 151 and 152 constitute a single structure.

When it is assumed that the mass of air in openings 151*a* and 152*a* is "m" and air put between first and second partition plates 151 and 152 serves as an air spring 155 of spring constant "k", a given vibration system with two factors (viz., "m" and "k") is established. For ease of description, this vibration system will be referred to "double factor vibration system" hereinafter.

In addition to the above-mentioned double factor vibration system, another vibration system is also provided in the modification, in which air 156 of mass "m" received in tubular portions 153 forms one factor of the vibration system. This vibration system has no resonance point and thus incident wave and transmitted wave are in the same phase. For ease of description, this vibration system will be referred to "single factor vibration system" hereinafter.

In the modification having the above-mentioned two, viz., single and double factor vibration systems, incident wave is separately treated by these two vibration systems. That is, one part of incident wave entering the single factor vibration system provides a transmitted wave having the same phase as the incident wave. While, the other part of incident wave entering the double factor vibration system provides a transmitted wave having a phase differing from that of the incident wave by 180 degrees. This means that the transmitted wave from the single factor vibration system and that from the double factor vibration system cancel out each other, and thus an appropriate sound shielding effect is obtained from the modification.

Figure 12:
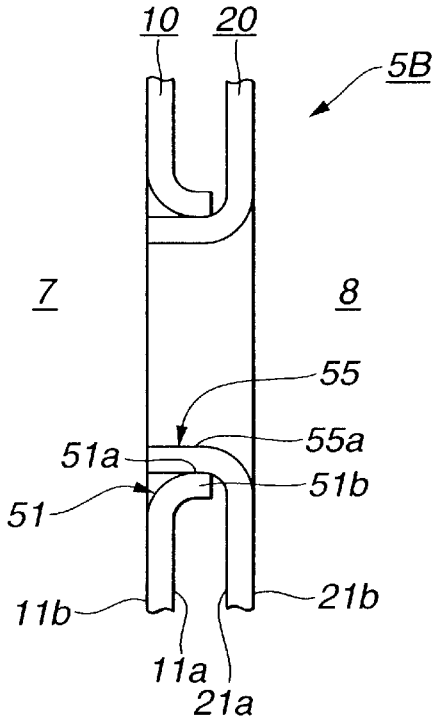
FIGS. 12, 13 and 14 are views similar to FIG. 4, but showing modifications of the positioning structure.
Figure 13:
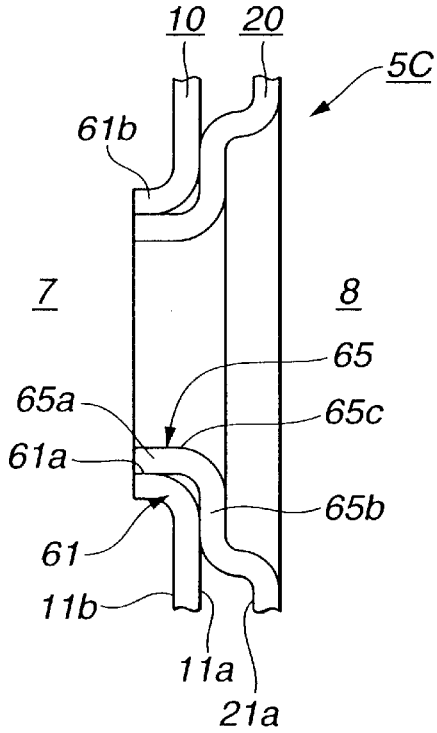
Figure 14:
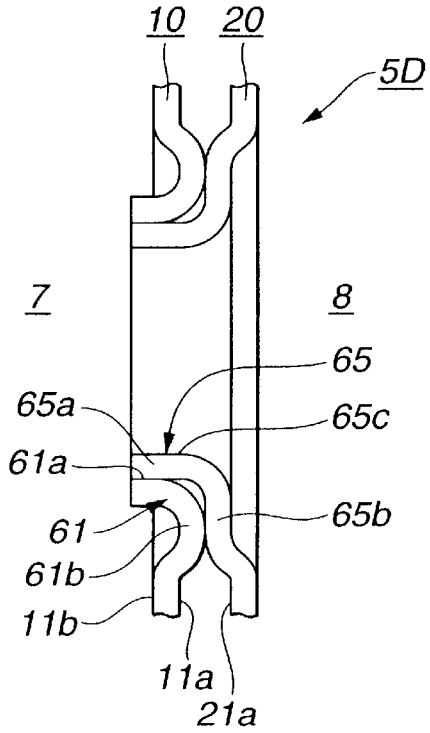
Figure 15:
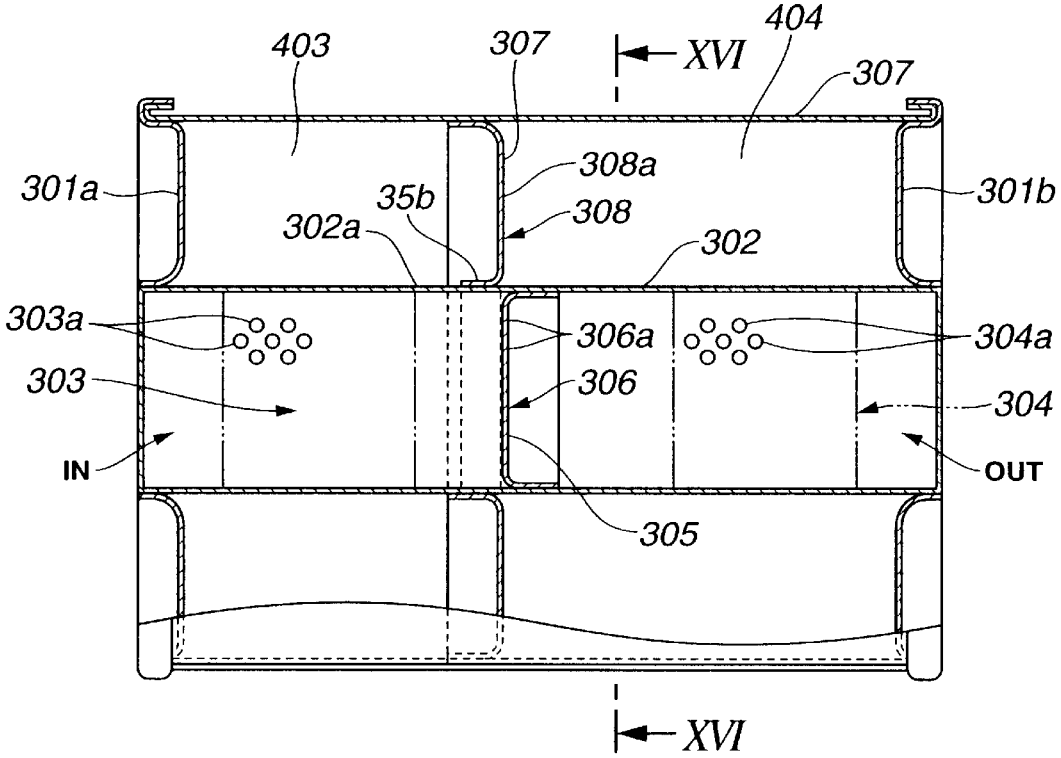
FIG.15 (RELATED ART)
FIG. 15 is a sectional view of a known muffler.
Figure 16:
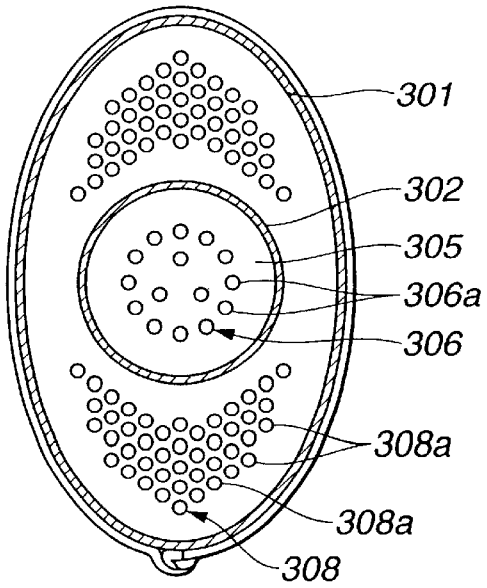
FIG.16 (RELATED ART)
FIG. 16 is a sectional view taken along the line "XVI—XVI" of FIG. 15.

Referring to FIGS. 12, 13 and 14, there are shown other modifications 5B, 5C and 5D of sound shielding wall structure 5 which may be employed in muffler 50 of the invention. As will become apparent from the following description, these modifications 5B, 5C and 5D have different structures on positioning projections 16 and 26 of first and second partition plates 10 and 20.

In modification 5B of FIG. 12, a positioning projection 55 possessed by second partition plate 20 is substantially the same as the above-mentioned positioning projection 26 of second partition plate 20 (see FIG. 4). While, a positioning projection 51 possessed by first partition plate 10 is different from the above-mentioned positioning projection 16 of first partition plate 10 (see FIG. 4). That is, in this modification 5B, positioning projection 51 has an annular leading end 51*b* that is directed toward second partition plate 20. Upon assembly, positioning projection 55 is intimately thrust into an opening 51*a* of positioning projection 51, as shown. With this, an opening 55*a* of positioning projection 55 provides a fluid communication between first and second sound chambers 7 and 8. Upon insertion of positioning projection 55 into opening 51*a*, the annular leading end 51*b* abuts against a root portion of positioning projection 55 thereby separating first and second partition plates 10 and 20 away from each other by a distance that is enough for keeping the predetermined distance "L" between the leading edge of each rearward projected portion 15 (see FIG. 3) of first partition plate 10 and that of corresponding forward projected portion 25 of second partition plate 20.

In modification 5C of FIG. 13, a positioning projection 65 possessed by second partition plate 20 has a stepped portion 65*b*, and a positioning projection 61 possessed by first partition plate 10 has an annular leading end 61*b* that is directed away from second partition plate 20. Upon assembly, an annular leading portion 65*a* of positioning projection 65 is intimately thrust into an opening 61*a* of positioning projection 61 from the back of first partition plate 10, as shown. With this, an opening 65*c* of positioning projection 65 provides a fluid communication between first and second sound chambers 7 and 8. Upon insertion of the annular leading portion 65*a* into opening 61*a*, stepped portion 65*b* of positioning projection 65 abuts against the rear surface of first partition plate 10 thereby separating first and second partition plates 10 and 20 away from each other by a distance that is enough for keeping the predetermined distance "L" between the leading edge of each rearward projected portion 15 (see FIG. 3) of first partition plate 10 and that of corresponding forward projected portion 25 of second partition plate 20.

In modification 5D of FIG. 14, a positioning projection 65 possessed by second partition plate 20 is substantially the same as that shown in FIG. 13. While, a positioning projection 61 is different from that shown in FIG. 13. That is, in this modification 5D, positioning projection 61 is provided with an annular raised portion 61*b* that is directed toward second partition plate 20. Upon assembly, an annular leading portion 65*a* of positioning projection 65 is intimately thrust into an opening 61*a* of positioning projection 61 from the back of first partition plate 10, as shown. With this, an opening 65*c* of positioning projection 65 provides a fluid communication between first and second sound chambers 7 and 8. Upon insertion of the annular leading portion 65*a* into opening 61*a*, stepped portion 65*b* of positioning portion 65 abuts against a top of the annular raised portion 61*b* of first partition plate 10 thereby separating first and second partition plates 10 and 20 away from each other by a distance that is enough for keeping the predetermined distance "L" between the leading edge of each rearward projected portion 15 (see FIG. 3) of first partition plate 10 and that of corresponding forward projected portion 25 of second partition plate 20.

In the above-mentioned modifications 5B, 5C and 5D of FIGS. 12 to 14, description is directed to only the positioning projections 51, 55, 61 and 65 which are used for achieving a relative positioning between first and second partition plates 10 and 20. However, if desired, the measures of such modifications 5B, 5C and 5D may be applied to projections 15 and 25 of first and second partition plates 10 and 20.

In the above-mentioned sound shielding wall structures 5, 5A, 5B, 5C and 5D, only one positioning structure is provided which comprises positioning projections 16 and 26, 51 and 55, and 61 and 65. However, if desired, two or more positioning structures may be employed for achieving much assured relative positioning between first and second partition plates 10 and 20. Furthermore, the positioning opening 16*a* of positioning projection 16 of first partition plate 10 may have a triangular shape, rectangular shape or the like, that is, an angled shape other than the above-mentioned oval shape.

The entire contents of Japanese Patent Application 2002-040636 filed Feb. 18, 2002 are incorporated herein by reference.

Although the invention has been described above with reference to one embodiment and modifications of the embodiment, the invention is not limited to such embodiment and modifications as described above. More modifications and variations of such embodiment may be carried out by those skilled in the art, in light of the above description.

What is claimed is:

1. A muffler comprising:

a case having opposed ends closed;

a partition structure installed in the case to constitute a sound silencing path;

inlet and outlet pipes incorporated with the sound silencing path; and a sound shielding wall structure installed in the case to constitute a part of the sound silencing path, wherein the sound shielding wall structure comprises:

first and second partition plates;

a positioning structure that puts the first and second partition plates together to keep a given distance therebetween;

a first group of projections defined by the first partition plate and projected toward the second partition plate, each projection of the first group having a first opening formed therethrough; and a second group of projections defined by the second partition plate and projected toward the first partition plate, each projection of the second group having a second opening formed therethrough, the projections of the second group respectively facing the projections of the first group having a given clearance kept therebetween.

2. A muffler as claimed in claim 1, in which a given number of the first group of projections are connected to a corresponding number of the second group of projections in such a manner that the first openings are directly connected to the second openings without leaving the given clearance therebetween.

3. A muffler as claimed in claim 2, in which the given number constitutes substantially a half of the projections of the first group.

4. A muffler as claimed in claim 3, in which the given number of projections of the first group are evenly distributed on the first partition plate.

5. A muffler as claimed in claim 1, in which the positioning structure comprises:

a first projection defined by the first partition plate and having a non-circular opening formed therethrough; and a second projection defined by the second partition plate, the second projection having a non-circular cross section and intimately inserted into the non-circular opening of the first projection.

6. A muffler as claimed in claim 5, in which the first projection has a rounded back portion that projects toward the second partition plate, and in which the second projection projects toward the first partition plate, the second projection being intimately inserted in the opening of the first projection from a backside of the first partition plate.

7. A muffler as claimed in claim 6, in which upon insertion of the second projection into the opening of the first projection, a top of the rounded back portion of the first projection abuts against a front surface of the second partition plate to keep the given distance between the first and second partition plates.

8. A muffler as claimed in claim 7, in which the second projection of the second partition plate is formed with a stepped portion that, upon insertion of the second projection into the opening of the first projection, abuts against the rear surface of the first partition plate thereby keeping the given distance between the first and second partition plates.

9. A muffler as claimed in claim 5, in which the first projection of the first partition plate has an annular leading end that projects toward the second partition plate, and in which the second projection of the second partition plate is intimately inserted into the opening of the first projection from a backside of the first partition plate.

10. A muffler as claimed in claim 1, in which the second partition plate has a peripheral portion welded to a peripheral portion of the first partition plate, and in which the peripheral portion of the first partition plate is welded to an inner wall of the case.

11. A muffler as claimed in claim 1, in which each of the projections of the first partition plate comprises an annular leading portion that projects toward the corresponding projection of the second partition plate, and in which each of the projections of the second partition plate comprises an annular leading portion that projects toward the corresponding projection of the first partition plate.

12. A muffler as claimed in claim 11, in which each of the annular leading portions of the projections of the first and second partition plates has a smoothly curved inner wall.

13. A muffler as claimed in claim 1, in which a given number of the projections of the second partition plate are intimately inserted into the openings of the projections of the first partition plate from a backside of the first partition plate.

14. A muffler as claimed in claim 1, in which the positioning structure is located at a given portion of the sound shielding wall structure where the first and second partition plates are subjected to a primary vibration of resonance in operation of the muffler.

15. A muffler comprising:

a case having opposed ends closed;

at least one partition plate installed in the case to divide an interior of the same into two chambers;

a sound shielding wall structure installed in one of the two chambers to divide the same into first and second sound chambers allowing the other one of the two chambers to serve as a third sound chamber; and pipe members projected into the case passing through the partition plate and the sound shielding wall structure to define in the case a sound silencing path including the first, second and third sound chambers, wherein the sound shielding wall structure comprises:

first and second partition plates;

a positioning structure that puts the first and second partition plates together to keep a given distance therebetween;

a first group of projections defined by the first partition plate and projected toward the second partition plate, each projection of the first group having a first opening formed therethrough; and a second group of projections defined by the second partition plate and projected toward the first partition plate, each projection of the second group having a second opening formed therethrough, the projections of the second group respectively facing the projections of the first group having a given clearance kept therebetween.

16. A muffler as claimed in claim 15, in which the pipe members comprise:

an inlet pipe that passes through the first sound chamber has an inner open end exposed to the second sound chamber;

an outlet pipe that passes through both third and second sound chambers and has an inner open end exposed to the first sound chamber; and a resonator pipe having one open end exposed to the second sound chamber and the other open end exposed to the third sound chamber.

17. A muffler as claimed in claim 16, in which the inlet and outlet pipes are respectively held by supporting portions possessed by the sound shielding wall structure.

* * * * *